US005851356A

United States Patent [19]

Banning et al.

[11] Patent Number: 5,851,356

[45] Date of Patent: Dec. 22, 1998

[54] METHOD AND APPARATUS FOR THE LATERAL SEALING OF A DRAINAGE WEDGE IN A TWIN-WIRE PAPER MACHINE

[75] Inventors: Jürgen Banning, Düren; Christian Schiel, Heidenheim, both of Germany

[73] Assignee: Voith Sulzer Papiermaschinen GmbH, Heidenheim, Germany

[21] Appl. No.: 839,852

[22] Filed: Apr. 17, 1997

[30] Foreign Application Priority Data

Apr. 19, 1996 [DE] Germany ..... 196 15 503.7

[51] Int. Cl.[6] ..... D21F 1/00

[52] U.S. Cl. ..... 162/203; 162/301; 162/353

[58] Field of Search ..... 162/199, 203, 162/334, 353, 301, 272, 317

[56] References Cited

U.S. PATENT DOCUMENTS 3,595,744 7/1971 Skoldkvist ..... 162/301

4,124,441 11/1978 Nyksopp ..... 162/353

5,054,154 10/1991 Balaha ..... 162/353

FOREIGN PATENT DOCUMENTS 1511238 9/1969 European Pat. Off. .

3737256 11/1988 European Pat. Off. .

*Primary Examiner*—Karen M. Hastings

*Attorney, Agent, or Firm*—Ostrolenk, Faber, Gerb & Soffen, LLP

[57] ABSTRACT

Apparatus and method for laterally sealing a drainage gap of a twin-wire paper machine. This lateral sealing has contact only with the lower wire. Between the upper wire and the lateral sealing, sealing is preferably effected by sealing water. Since this lateral sealing is elastic, it can adapt itself to the movements of the lower wire.

17 Claims, 3 Drawing Sheets

METHOD AND APPARATUS FOR THE LATERAL SEALING OF A DRAINAGE WEDGE IN A TWIN-WIRE PAPER MACHINE

BACKGROUND OF THE INVENTION

The present invention relates to a method and apparatus for the lateral sealing of a drainage wedge in the wire end of a twin-wire paper or board machine.

Twin-wire paper or board machines have become known in large number and great variety. The two main types are the so-called gap former and the hybrid former.

In the gap former, a wedge-shaped inlet gap for the injecting of a full-width jet of pulp slurry coming from the headbox is formed between two wires. The wires are contacted practically simultaneously by the slurry. The start of the inlet gap is located at the breast rolls which deflect the wires. The center lines of these rolls lie—seen in the direction of travel of the wire—more or less opposite each other.

In the hybrid former, the jet of pulp is applied first to the lower one of the two wires and carried along by it a certain distance within which the pulp slurry is subjected to a preliminary dewatering and only then is the other wire brought against the partially dewatered pulp slurry so that the paper web which is now produced is surrounded in sandwich-like manner. The preliminary dewatering path can in this case be relatively short so that the transition between the gap former and the hybrid former is a fluid one.

A problem area of such formers is the initial region of the dewatering path. In this connection, namely, the pulp slurry can emerge between the edges of the two wires unless other measures are taken. This emergence of the slurry leads to the loss of fiber material upon the formation of the sheet or between the wires and impairs, among other things, the thickness of the sheets and the orientation of the fibers in the region of the edge of the sheet, so that then relatively wide marginal strips of the paper are of poorer quality than the rest of the paper. Lateral seals consisting of stationary limiting surfaces have the disadvantage that substantial wear will take place between them and the two wires.

SUMMARY OF THE INVENTION

An object of the present invention is to develop a lateral sealing of the wedge gap between two wires of a twin-wire paper machine, particularly for use in the manufacture of heavier grades of paper—and therefore with relatively thick layers of pulp slurry—in such a manner that the emergence of pulp between the two wires is minimized while the amount of wear is still tolerable.

The above and other objects are achieved by a method for laterally sealing a substantially wedge-shaped gap in a common drainage path between two wires of a twin-wire paper machine, the two wires for conveying a pulp slurry therebetween, the method comprising providing a sealing spacer between the two wires at lateral edges of the wires and fixed in the direction of travel of the pulp slurry when the paper machine is in operation producing paper; providing a gap between the sealing spacer and an upper one of the two wires; and sealing the gap with a sealing liquid.

The objects of the invention are furthermore achieved by an apparatus for laterally sealing a substantially wedge-shaped gap in a common drainage path between two wires of a twin-wire paper machine, the two wires for conveying a pulp slurry therebetween, the apparatus comprising a sealing spacer disposed between the two wires at lateral edges of the two wires, the sealing spacer being fixed in the direction of travel of the pulp slurry when the paper machine is in operation producing paper, a gap being provided between the sealing spacer and an upper one of the two wires and a fluid connection for providing sealing fluid into the gap between the upper wire and the spacer.

In the preferred embodiment of the invention, the sealing spacer lies on the lower wire. The upper wire rests under tension against upper stationary dewatering ledges. The sealing spacer is at a defined distance from these upper dewatering ledges and from spacers adjacent the upper dewatering ledges. This defined distance is greater than the thickness of the upper wire. The gap formed between the upper wire and the sealing spacer is acted on, in operation, preferably by sealing water so that the fiber slurry cannot flow into this gap. The contact surface between sealing spacer and lower wire is lubricated hydrodynamically with water present in the meshes of the wire.

Since at least one lower dewatering ledge can be pressed resiliently by pressure hose against the lower wire, thus carrying out a vertical stroke, and the wire being also moved along, it is necessary for the sealing spacer to be flexible and to rest closely against the lower wire.

In typical paper machines, since the wires may move out laterally during operation of the paper machine, the wires might, in case of a rigid lateral outer wall, experience a hard surface contacting against it and thus be subjected to wear. Conversely, upon the moving away of the wire, the sealing action would be lost. This is not possible in the case of the invention. Due to the formation of a sealing gap between the top of the sealing spacer and the surface of the upper wire facing it, there can be no striking against this edge of the web. Since the sealing spacer rests on the lower web, there can be no striking against the web there either. The sealing spacer is hydrodynamically lubricated by lying on the lower wire.

The elasticity of the sealing spacer vertical to its longitudinal length can be achieved in two different manners. on the one hand, the use of a soft material assures the flexibility of the sealing spacer. On the other hand, the development of the sealing spacer from individual plates of even a rigid material permits this flexibility. The sealing spacer—either developed in one piece or of individual plates—then need merely be fixed at its thicker end during operation of the paper machine in order to avoid its being carried along in the direction of travel of the wire.

Depending on the production circumstances, the two wires can be brought into a defined distance from each other. This means, in other words, that the dewatering gap varies. In order that the sealing spacer can be used for the different gap adjustments, it must be displaceable in and opposite the direction of travel of the web.

Other features and advantages of the present invention will become apparent from the following description of the invention which refers to the accompanying drawings.

BRIEF DESCRIPTION OF THE DRAWINGS

The invention will be explained further with reference to the drawings in which.

DETAILED DESCRIPTION OF EMBODIMENTS OF THE INVENTION

Figure 1:
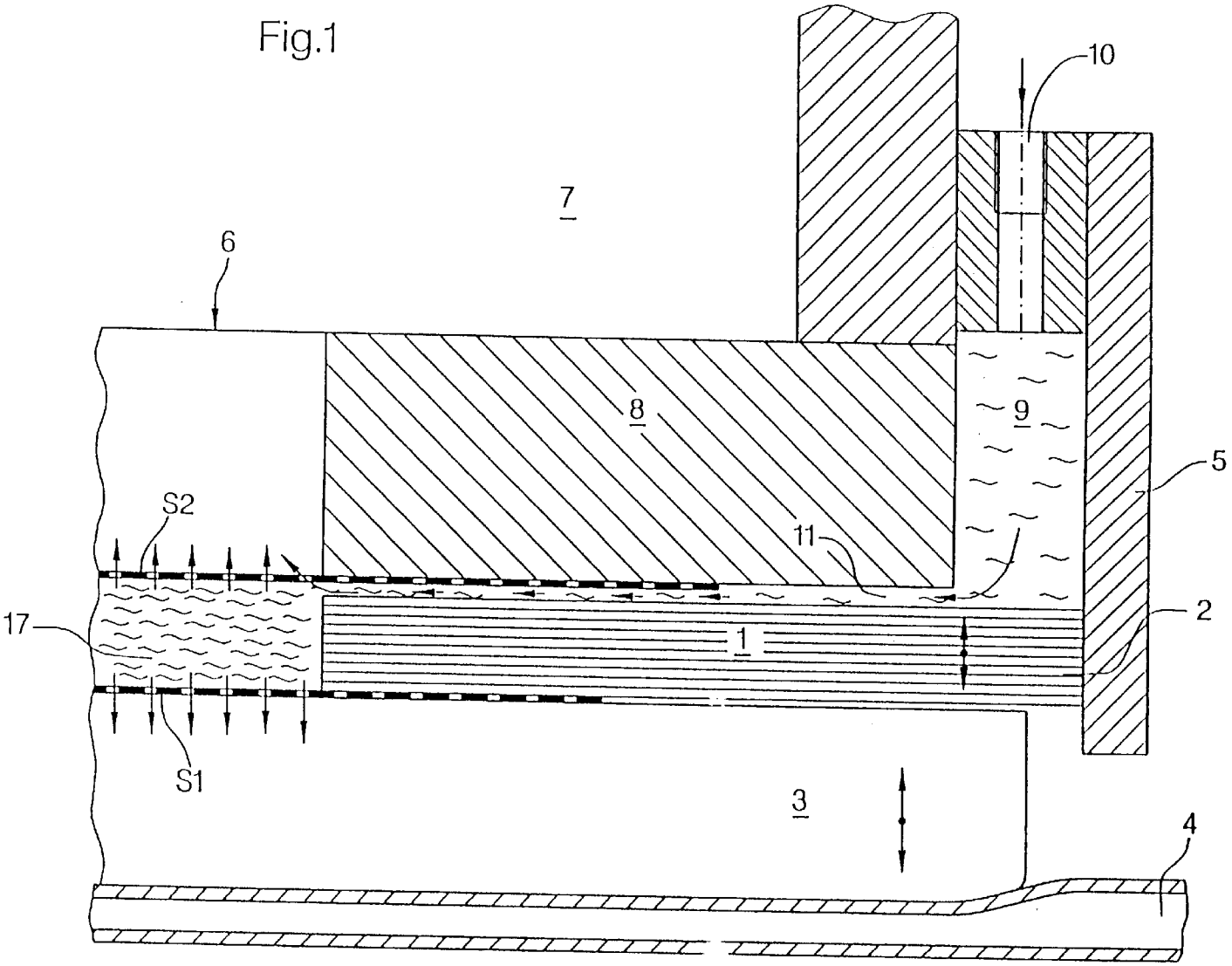
FIG. 1 is a partial cross-section through a twin-wire former in a view transverse to the direction of travel of the web showing the invention.

With reference now to the drawings, FIG. 1 shows a transverse cross-section of a portion of a paper machine in the region of the edge of a twin-wire former according to the invention. The sealing spacer 1 shown consists of stacked plates 2 extending in the direction of travel of the wire, either into or out of the paper. In this case, the lowest plate is the longest. The ones arranged above it are increasingly shorter. The plates 2 are held together at one end in the vicinity of the headbox 12 (see FIG. 2) by an attachment, not shown. The spacer 1 is longitudinally movable, as shown by arrow 15, (FIG. 2) to take into account manufacturing circumstances.

Due to the dewatering pressure between the wires S1, S2, the sealing spacer 1 lies against the side supporting wall 5. The lower wire S1 lies on the lower dewatering ledges 3. The lower dewatering ledges 3 are pressed by a pressure hose 4 against the wire S1. The upper wire S2 lies against the upper stationary dewatering ledges 6. The space adjacent the upper dewatering ledges 6 is filled with spacers 8 in the region of the edge. These spacers 8 can be so-called deckle adjusting devices. The edge of the sealing spacer 1 facing the pulp slurry 17 is substantially flush with the inner edge of the spacer 8. Via the sealing-water connection 10 and a pre-chamber 9, sealing water flows through the gap 11 between the upper wire S2 and the sealing spacer 1 in the direction of the pulp slurry 17. The amount of sealing water is so determined that there is no penetration of particles of fiber into the gap 11.

Figure 2:
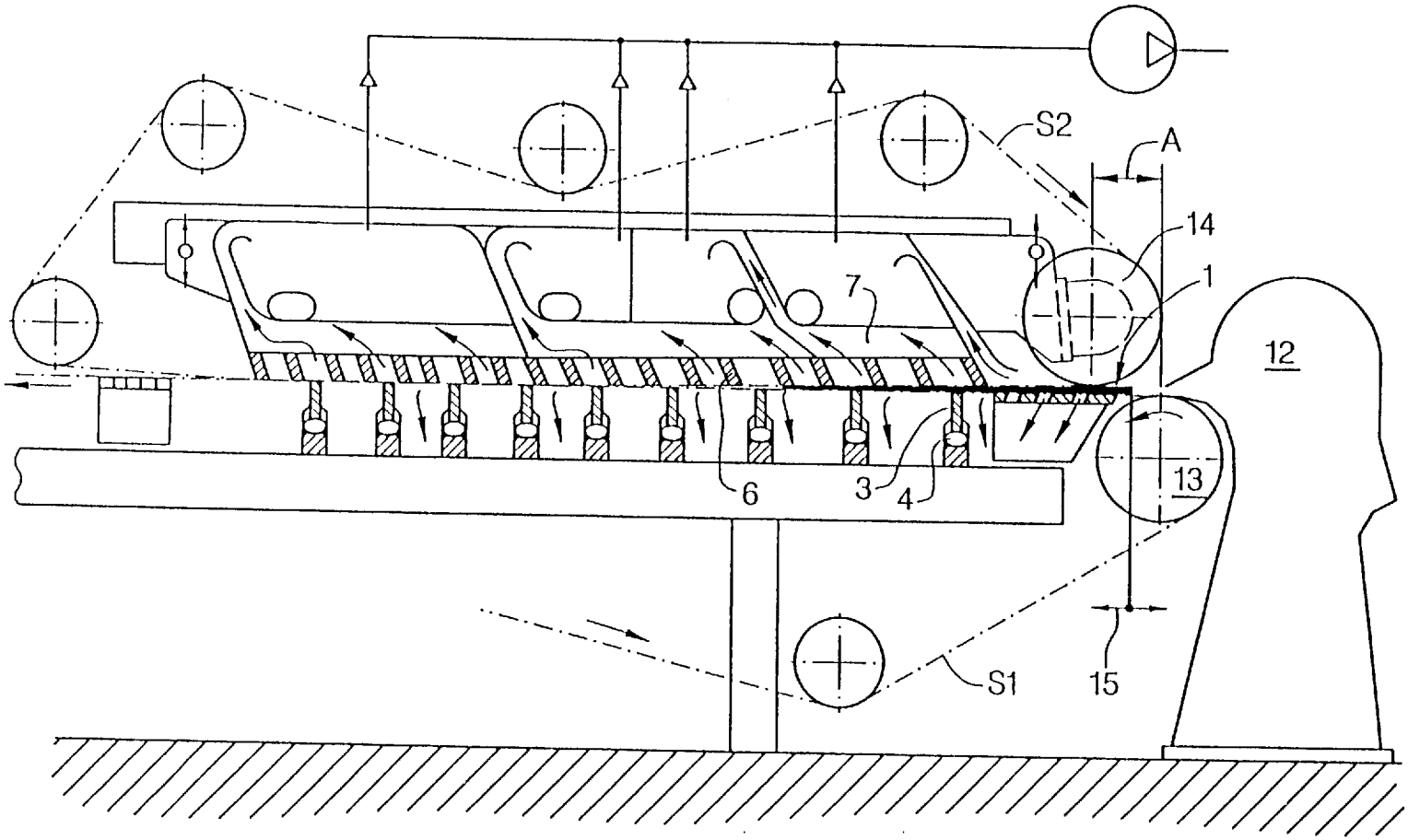
FIG. 2 is a longitudinal cross-section through a twin-wire former of the hybrid type but also illustrating a gap former.

In FIG. 2, the upper wire S2 is conducted over the upper breast roll 14 to the pulp slurry 17. The drainage elements 3, 6 are so arranged that a long drainage gap is produced between the wires S1, S2. The former shown is a so-called hybrid former since the pulp slurry 17 coming from the headbox 12 is deposited onto the lower wire S1 without the upper wire S2 also initially having contact with the pulp slurry 17.

If the dimension A shown between the breast rolls 13, 14 were practically zero, then the pulp slurry 17 would come into contact with the wires S1, S2 simultaneously and the former would be a gap former. From the preceding, it is clear that the sealing spacer of the invention can be used for both types of former. If the distance between the wires S1, S2 changes as a result of the production—for instance, upon change of the type of paper—there could either result a jamming of the sealing spacer or too large a gap between upper wire S1 and sealing spacer 1. For this reason, the sealing spacer 1 has a displacement path 15. Because the spacer 1 is wedge-shaped, moving it longitudinally will vary the size of the sealing gap 11.

Figure 3:
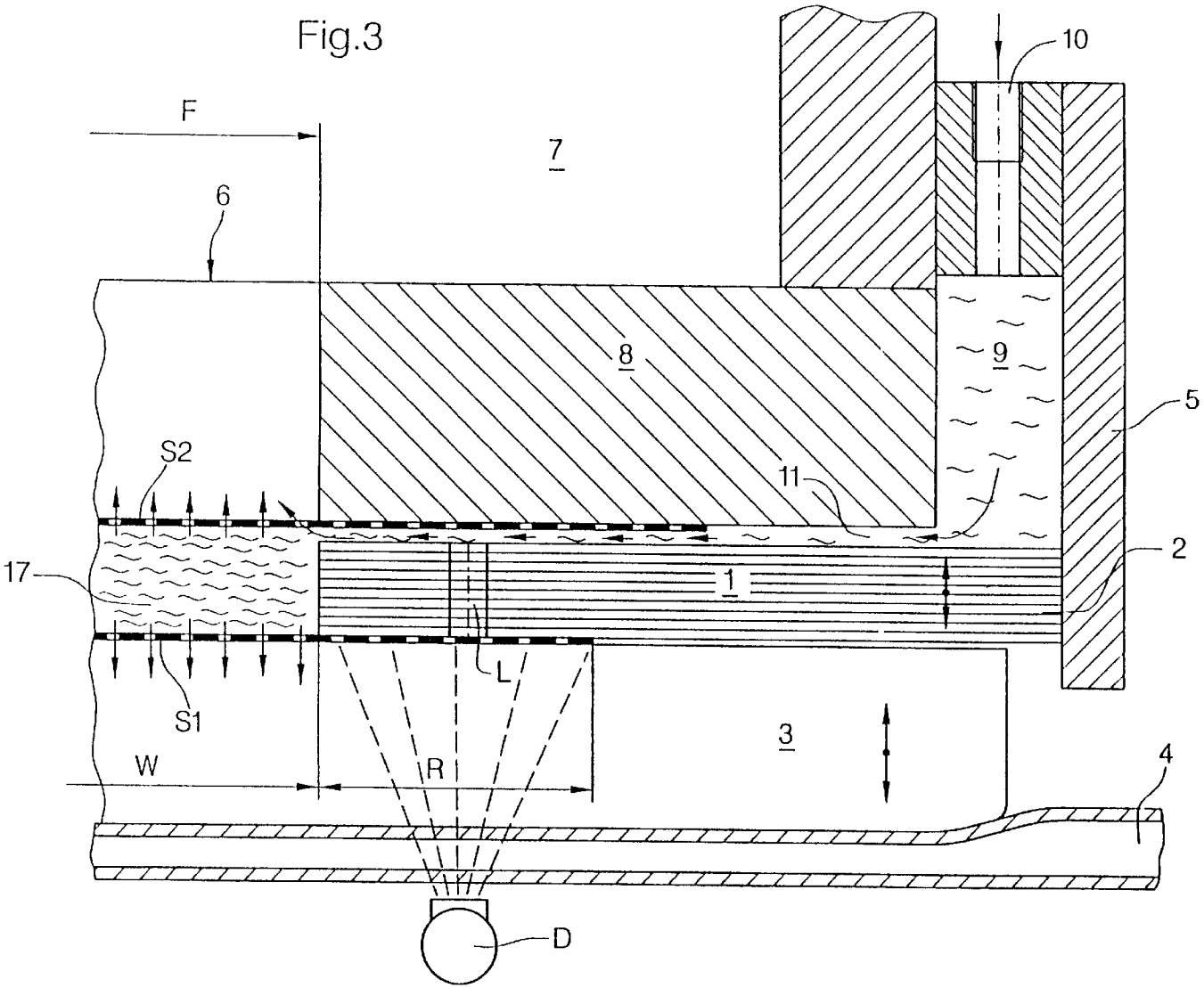
FIG. 3 is a partial cross-section through a twin wire former in a view transverse to the direction of the travel of the web showing further embodiments.

FIG. 3 shows further variants of the sealing of a drainage gap in a twin-wire former. In this case, the lower wire S1 is made water-impervious in the region of the edge R by a plastic, by the pasting-on of a foil, or by similar measures. The lower wire S1 is so guided by a wire guide that the water-pervious part W of the wire travels substantially symmetrically between the inner edges of the spacer 8 which face the slurry 17. The width of the water-pervious region W of the lower wire S1 corresponds in this connection substantially to the dimension F, which corresponds to the distance apart of the inner edges of the spacer 8 from the operator and drive sides. The dimension may, e.g., be up to 25 mm, 5 to 25 mm, smaller than the dimension F.

A further development is the additional lubrication of the lower wire S1. With regard to this, two variants are shown in FIG. 3. In the one variant, the wire S1 is lubricated on its surface of contact with the sealing spacer 3. Via openings L in the sealing spacer 1, sealing liquid 9 comes against this contact surface. In the second variant, the contact surface of the wire S1 with the lower ledges 3 is lubricated via at least one, for instance, flat-jet nozzle D. Of course, these two possibilities of lubrication can also be applied simultaneously.

Although the present invention has been described in relation to particular embodiments thereof, many other variations and modifications and other uses will become apparent to those skilled in the art.

Therefore, the present invention should be limited not by the specific disclosure herein, but only by the appended claims.

What is claimed is:

1. A method for laterally sealing a substantially wedge-shaped gap in a common drainage path between two wires of a twin-wire paper machine, the two wires for conveying a pulp slurry therebetween, the method comprising:

providing a sealing spacer between the two wires at lateral edges of the wires fixed in the direction of travel of the pulp slurry when the paper machine is in operation producing paper;

providing a gap between the sealing spacer and an upper one of the two wires; and sealing the gap with a sealing liquid.

2. Apparatus in combination with and for laterally sealing a substantially wedge-shaped gap in a common drainage path between two wires of a twin-wire paper machine, the two wires for conveying a pulp slurry therebetween, the apparatus comprising:

a sealing spacer disposed between the two wires at lateral edges of the two wires, the sealing spacer being fixed in the direction of travel of the pulp slurry when the paper machine is in operation producing paper;

a gap being provided between the sealing spacer and an upper one of the two wires; and a fluid connection for providing sealing fluid into the gap between the upper wire and the spacer.

3. Apparatus in combination with and for laterally sealing a substantially wedge-shaped gap in a common drainage path between two wires of a twin-wire paper machine, the two wires for conveying a pulp slurry therebetween, the apparatus comprising a sealing assembly comprising a substantially wedge-shaped sealing spacer extending in the direction of travel of a pulp slurry carried by the wires, the spacer not being in contact with an upper one of the wires and resting on a lower one of the wires, a lateral support wall for the spacer being provided at a location transversely away from the wires and a sealing-liquid connection for providing a sealing liquid into the wedge-shaped gap.

4. The apparatus of claim 3, wherein the sealing spacer comprises a single piece.

5. The apparatus of claim 3, wherein the sealing spacer comprises individual plates extending in the direction of travel of the pulp slurry.

6. The apparatus of claim 3, wherein the sealing spacer is flexible.

7. The apparatus of claim 4, wherein the sealing spacer is flexible.

8. The apparatus of claim 5, wherein the sealing spacer is flexible.

9. The apparatus of claim 3, further comprising at least one stationary upper ledge above the spacer forming the gap with the spacer, the gap being filled with sealing water.

10. The apparatus of claim 3, wherein the sealing spacer is displaceable in the direction of travel of the pulp slurry and in the direction opposite thereto.

11. The apparatus of claim 3, wherein a lower one of the wires is water-impervious in a region adjacent an edge of the wire.

12. The apparatus of claim 11, wherein the lower wire is guided so that the water-pervious region is substantially symmetrical to a dimension F transverse to the wires between inner edges of stationary ledges disposed above the sealing spacer adjacent edges of the wires.

13. The apparatus of claim 12, wherein the water pervious region comprises a dimension W transverse to the wires, the dimension W being substantially equal to the dimension F between the inner edges of the stationary edges adjacent edges of the wires.

14. The apparatus of claim 12, wherein the water pervious region comprises a dimension W transverse to the wires, the dimension W being 5 to 25 mm smaller than the dimension F between the inner edges of the stationary edges adjacent edges of the wires.

15. The apparatus of claim 3, wherein a top surface of a lower one of the wires is connected by openings through the sealing spacer for conveying sealing liquid to lubricate an area of contact between the lower wire and the sealing spacer.

16. The apparatus of claim 3, further comprising a lubricating nozzle arranged close to a bottom side of a lower one of the wires in the region of an edge of the lower wire for conveying a lubricating liquid to an area of contact between the lower wire and the sealing spacer.

17. The apparatus of claim 16, wherein the nozzle is a flat jet nozzle.

* * * * *